United States Patent [19]

Hermann et al.

[11] 4,166,259

[45] * Aug. 28, 1979

[54] FLAT HIGH FREQUENCY CABLE

[75] Inventors: Walter Hermann, Weissenfeld; Burkhart Kühl, Ottobrunn; Wolf-Dieter Schuck, Putzbrunn, all of Fed. Rep. of Germany

[73] Assignee: Messerschmitt-Bölkow-Blohm GmbH, Munich, Fed. Rep. of Germany

[ * ] Notice: The portion of the term of this patent subsequent to May 9, 1995, has been disclaimed.

[21] Appl. No.: 851,945

[22] Filed: Nov. 16, 1977

Related U.S. Application Data

[63] Continuation-in-part of Ser. No. 708,217, Jul. 23, 1976, Pat. No. 4,088,971.

[30] Foreign Application Priority Data

Aug. 8, 1975 [DE] Fed. Rep. of Germany ..... 2535381
Oct. 11, 1975 [DE] Fed. Rep. of Germany ..... 2545669
Oct. 21, 1975 [DE] Fed. Rep. of Germany ..... 2547011

[51] Int. Cl.[2] ..... H01P 3/00

[52] U.S. Cl. ..... 333/236; 174/117 FF; 333/245

[58] Field of Search ..... 179/82; 325/51; 340/47 R; 246/122 R, 167 D; 333/84 R, 96, 97 R; 174/117 F, 117 FF

[56] References Cited

U.S. PATENT DOCUMENTS

| | | | |
|---|---|---|---|
| 3,450,874 | 6/1969 | Whitten | 246/122 R X |
| 3,817,344 | 6/1974 | Asano et al. | 246/122 R X |
| 3,902,689 | 9/1975 | Hermann et al. | 246/167 D X |
| 3,904,157 | 9/1975 | Kühl | 246/167 D X |

*Primary Examiner*—Paul L. Gensler
*Attorney, Agent, or Firm*—W. G. Fasse; D. F. Gould

[57] ABSTRACT

A flat, high frequency cable having a number of longitudinal conductors, is provided with a transverse conductance between said longitudinal conductors. The transverse conductance is substantially smaller than the conductivity of said longitudinal conductors to provide a defined attenuation along the cable. The transverse conductance is determined by a plurality of discrete components such as resistors and capacitors electrically connected to said longitudinal conductors at spaced intervals. The present cable may comprise two or three conductors.

16 Claims, 13 Drawing Figures

Fig. 6
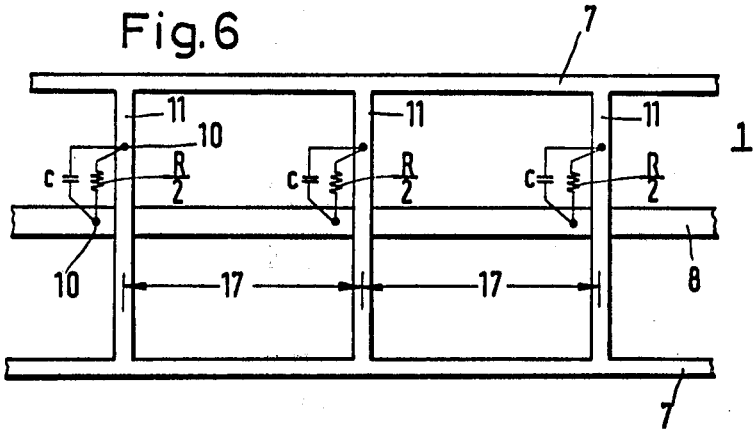
Fig. 7
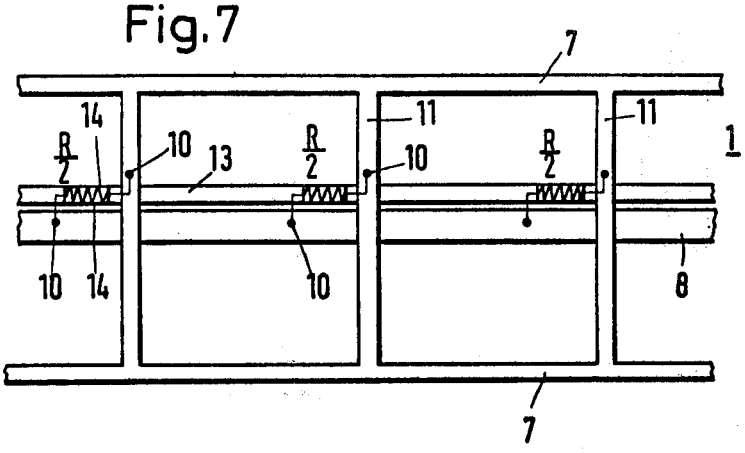
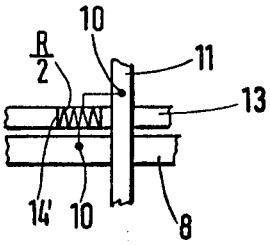
Fig. 8

FLAT HIGH FREQUENCY CABLE

BACKGROUND OF THE INVENTION

The present application is a continuation-in-part application of my copending application U.S. Ser. No. 708,217, filed July 23, 1976, now U.S. Pat. No. 4,088,971.

The present invention relates to flat, high frequency cables having at least two longitudinal conductors spaced from each other and interconnected with each other along their entire lengths. The conductors are arranged in parallel to each other and held in position by insulating means. Such cables are used, for example, in transmitting high frequency signals from a transmitter to a receiver located at close proximity to each other in the so-called near field. The transverse conductance in such cables is substantially lower than the conductivity of the longitudinal conductors.

Cables of this type are used, for example, for precisely measuring the distance between vehicles on a track, for instance, as disclosed in U.S. Pat. No. 3,836,770 granted on Sept. 17, 1974. In prior art cables of this type the transverse conductance is established by means of a layer of an electrically conducting synthetic material, whereby especially synthetic foils are used. U.S. Pat. No. 3,809,803 granted May 7, 1974 describes a cable in which the transverse conductance is accomplished by a conducting foil made of a plastic material having a carbon coating thereon.

Such a cable satisfies the requirements of the use for which the cable is intended in an excellent manner. However, the manufacturing of such cables is expensive because substantial difficulties are encountered in providing suitable contact means between the longitudinal conductors and the electrically conducting carbon coated synthetic foil which must have a conductivity within narrow tolerance limits. Providing the necessary contacts between the longitudinal conductors and the carbon coated foil becomes especially involved and hence expensive if it is necessary to assure a uniform and reproducible constancy as well as a geometrical and time constancy. In other words, the contacts must remain where they are intended over prolonged periods of time. These latter conditions are especially hard to maintain where the cable is intended for various kinds of uses and not only for the distance measuring.

OBJECTS OF THE INVENTION

In view of the above, it is the aim of the invention to achieve the following objects, singly or in combination:

to provide a flat, high frequency cable with a precisely defined transverse conductance between the longitudinal conductors of the cable whereby such traverse conductance must be reproducible with precision and by reasonably inexpensive manufacturing means;

to provide a flat, high frequency cable in which the transverse conductance may be adapted to the particular type of use with the desired quality of approximation;

to avoid the use of electrically conducting synthetic foils in the manufacturing of cables of this type by the use of discrete circuit components such as resistors and/or capacitors;

to adjust and/or align the discrete components by mechanically machining these components; and to provide a high frequency, two conductor cable with a defined attenuation along its length wherein the discrete resistors and/or capacitors interconnect the longitudinal conductors at positions having predetermined spacings therebetween.

SUMMARY OF THE INVENTION

According to the invention there is provided a flat, high frequency cable having a plurality of longitudinal conductors interconnected at spaced intervals by discrete circuit components such as discrete resistors and/or capacitors spaced from each other at predetermined spacings, especially uniform spacings.

Such discrete circuit components may be manufactured in a simple manner with close tolerances and constant characteristics with regard to time whereby even mass production meets these requirements. Another advantage of the invention is seen in that the contacting between the discrete circuit components and the longitudinal conductors does not involve any technical difficulties since such contacts may be established by, for example, soldering, welding, crimping, or even gluing with an electrically conductive adhesive which as such is well known in the art. The geometric constancy of the cable characteristics is assured by the uniform spacing between the discrete components.

According to the invention, the electrically conductive foil of the prior art is replaced and approximated by a ladder network whereby the quality of approximation is adapted to the requirements of the particular use for which the cable is intended. According to the invention there is further provided a flat, high frequency cable for cooperation with coupling members having a given length and forming part of transmitter and receiver means, said cable comprising longitudinal conductor means having a given conductivity and including at least two longitudinal conductors, insulating means locating said conductor means in spaced relationship relative to each other along their entire length, discrete transverse conductor means having a transverse conductivity substantially smaller than said given longitudinal conductivity, said discrete transverse conductor means comprising a number of discrete components, and means connecting said discrete components to said longitudinal conductors along the length thereof to provide a defined attenuation along the cable, said discrete components and their connections to said longitudinal conductor means being spaced from each other by a distance corresponding to a whole number fraction of said given length of said coupling members.

BRIEF FIGURE DESCRIPTION

In order that the invention may be clearly understood, it will now be described, by way of example, with reference to the accompanying drawings, wherein:

FIG. 1 illustrates in a symbolized manner a section of a track system on which two vehicles such as passenger cabins travel in succession;

FIGS. *2a–2d* illustrate vector diagrams showing the currents in the high frequency flat cables;

FIG. 6 is an embodiment similar to that of FIG. 5, however, the discrete circuit components comprise a resistor and a capacitor connected in parallel to each other at each interval;

FIG. 7 is an embodiment in which an additional carrier strip is provided for the discrete circuit elements;

FIG. 8 illustrates a modification of the embodiment of FIG. 7;

FIGS. 9, 10 show perspective views of the wave shapes with which cables of the invention may be provided to facilitate their installation in curves or the like;

DETAILED DESCRIPTION OF PREFERRED EXAMPLE EMBODIMENTS

Figure 1:
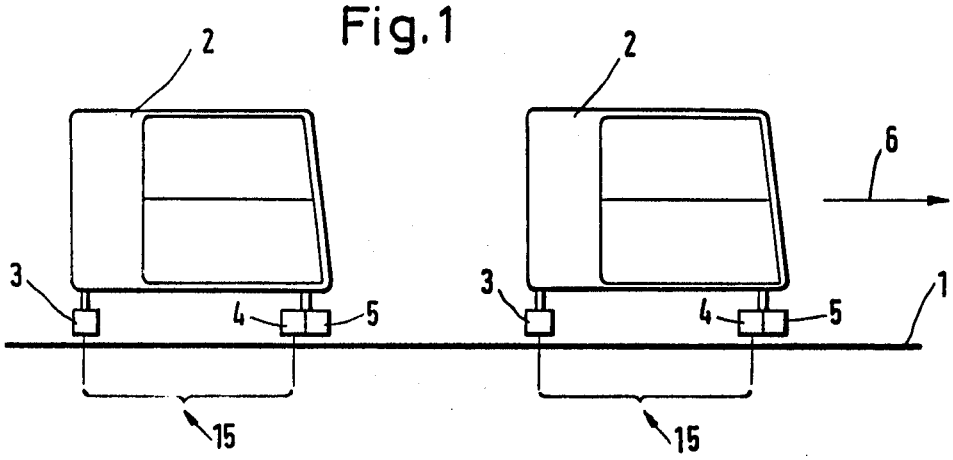

Referring to FIG. 1 which illustrates the use of the present invention, the flat, high frequency cable 1, is installed alongside a track not shown in detail. The cable 1 is used for measuring the spacing or distance between two adjacent vehicles 2. Each vehicle carries a transmitter coupler 3, a compensating coupler 4 and a receiver coupler 5. The vehicles travel in the direction of the arrow 6 along the track. The signals emitted by the transmitter coupler 3 of any vehicle are received by the receiver coupler 5 of the next following vehicle on the track whereby the intensity of the received signal may, for example, be a measure for the spacing between two adjacent vehicles 2. Due to the attenuation provided in the high frequency, flat cable 1, the intensity of the signal on the cable is reduced relatively quickly. The attenuation is accomplished by the transverse conductance between the longitudinal conductors of the cable. Such transverse conductance is provided according to the invention by means of discrete circuit components such as resistors and/or capacitors.

The efficiency (E) of the directional coupler 15 comprising the transmitter coupler 3 and the compensating coupler 4, is defined as the ratio between the current amplitude $J_S$ fed into the cable 1 by the compensator coupler 4 in the direction opposite to that of the traveling direction indicated by the arrow 6, to the current amplitude $J_{SS}$ delivered solely by the transmitter coupler 3 at the location of the transmitter thus, $E=J_S/J_{SS}$. The resulting current vector $J_S$ will now be explained with reference to the vector diagrams of FIGS. 2a, 2b, 2c, and 2d. The transmitter coupler 3 produces at its instantaneous location the current $J_{SS}$ in the cable 1, see FIG. 2a. At the location of the compensating coupler the current $J_{SS}$ becomes a current $J_{SK}$ which in the present example has a phase shift of 16°, see FIG. 2b. Simultaneously, the compensating coupler 4 feeds the current $J_{KK}$ into the high frequency cable 1. The current $J_{KK}$ is of the same size as the current $J_{SK}$, however, the two current $J_{SK}$ and $J_{KK}$ are in opposing phase relationship to each other. Thus, the transmitter and compensating coupling currents cancel each other in the traveling direction indicated by the arrow 6. Thus, no transmission takes place in the traveling direction 6 of the behicles 2. At the location of the transmitter coupler 3 the current $J_{KK}$ becomes the current $J_{KS}$ which is further phase shifted by another 16° making the total phase shift 32° relative to the current $J_{SS}$ rotated by 180°. The current $J_{KS}$ is now added in a vector manner to the current $J_{SS}$ which results in the current $J_S$ actually supplied in the direction opposite to the traveling direction.

Figure 2A:
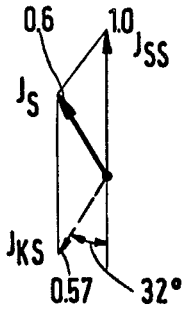
Figure 2B:
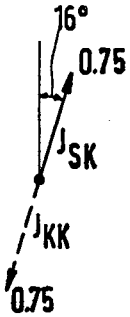
Figure 2C:
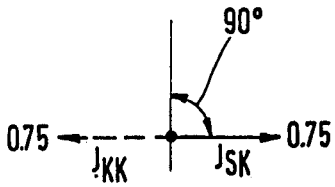
Figure 2D:
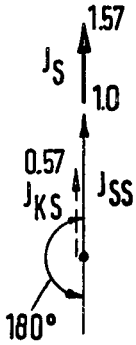

By using the capacitor C (FIG. 6) the above mentioned phases may be shifted so that the efficiency as defined above may be increased as shown in FIGS. 2c and 2d. In FIG. 2a the efficiency for the current $J_S$ is 0.6. In FIG. 2d the efficiency is the sum of $0.57+1.0=1.57$.

When the attenuation of the cable is 1.5 dB/m then the phase shift in an embodiment without a capacitor C as shown in FIGS. 2a and 2b degrees per meter. In the embodiments employing the capacitor C and illustrated in FIGS. 2c and 2d the phase shift is 55 degrees per meter.

The arrangement of the discrete circuit components will now be described with reference to FIGS. 3-8. The illustrated high frequency flat cable 1 comprises two outer conductors 7 and a central conductor 8. In the simplest embodiment of FIG. 3 the transverse conductance is provided by a plurality of ohmic resistors R connecting the outer conductors 7 to the central conductor 8. A pair of resistors R is provided in each section 9 of the cable 1. Each pair of resistors R is spaced from the next adjacent pair by a spacing 17. The shown arrangement requires four contacts 10 for each section. These contacts may be accomplished by crimping, welding, soldering, or any other suitable technique such as bonding by means of an electrically conductive adhesive. Bonding by ultrasonic welding may also be employed to form the contacts. The number of resistors R may be reduced as shown in the arrangement according to FIG. 4 wherein each section 9 is provided with a single resistor the value of which is one half of that of the value of the resistor R in FIG. 3. Further, in FIG. 4 the longitudinal conductors 7 are short circuits in each section 9 by a short circuit conductor 12. The contacts between the longitudinal outer conductors 7 and the short circuit conductors 12 may be made in the same manner as described above with reference to FIG. 3. The resistor is connected to the central conductor 8 on the one hand, and to the short circuit conductor 12 on the other hand.

The number of required contacts may be reduced as shown in the embodiments of FIGS. 5-8 in which the outer conductors 7 and the short circuiting conductors 11 are formed by die punching from a conductor foil thus eliminating the contacts between the longitudinal conductors 7 and the short circuiting conductors 11. Merely the contacts 10 between the center conductor 8 and the resistor as well as the contacts between the resistor and the short circuiting conductors 11 are required. As illustrated in FIG. 6 capacitors C may be connected in parallel to the resistors whereby it is possible to shift the phase of the current amplitudes in the cable 1 as has been described above with reference to FIG. 2. Such phase shift has the advantage to substantially increase the efficiency as mentioned above.

Mass production of the present cable may be simplified by securing the discrete circuit elements such as resistors R and R/2 on a supporting strip 13 which in turn becomes part of the cable 1 by establishing the contacts between the resistors and the central conductor 8 as well as the short circuiting conductors 11. The resistors or other circuit elements will be secured to the supporting strip 13 at defined locations, for example, at uniform spacings. If it should be necessary to balance the resistors, this may be accomplished by mechanical machining of the resistors. Such machining could reduce the cross section of the resistors, for example, by cutting their longitudinal side 14 as shown in FIG. 7. In this instance the strip 13 and the longitudinal sides 14 of the resistors would be cut in a single operation. FIG. 8 illustrates a modification of the mechanical machining of the resistors having a somewhat different configuration. The ends 14' of the resistors may be machined, for example, by filing or the like. Such filing is easily accomplished by conventional means.

The use of discrete circuit elements R, R/2, and C make it possible to reproduce the cables according to the invention with any desired degree of accuracy. This also applies to the locating and manufacturing of the contact points. Another advantage is seen in that a balancing is easily accomplished as described by the mechanical machining of the discrete circuit elements. The use of ohmic resistors R/2 as illustrated in FIGS. 4–8, and if desired, in combination with capacitors C as illustrated in FIG. 6 enforces a symmetry along the entire length of the cable. Thus, troubles or malfunctions that may be due to a nonsymmetrical coupling of the signal in the cable are diminished where the coupler is shifted laterally with respect to the cable. In this context the term "coupler" means the pole piece, for example, of the transmitter coupler 5 which is secured to the vehicle 2 so as to leave an air gap above or below the cabler 1.

As described above with reference to FIG. 2, the use of discrete capacitors C as shown in FIG. 6 increase the efficiency of the directional coupler in a technical as well as in an economical sense, thereby achieving an optimum efficiency.

Figure 9:
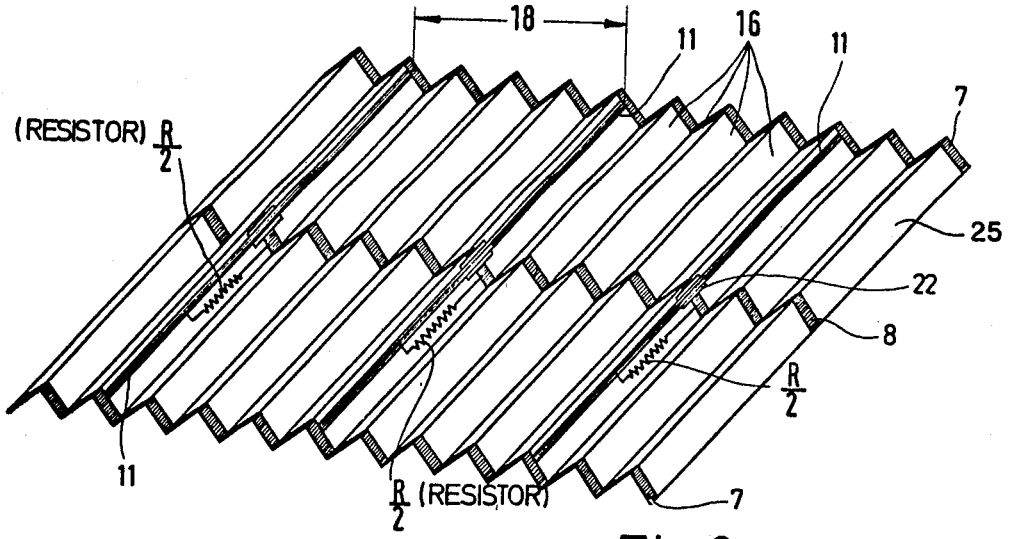
Figure 10:
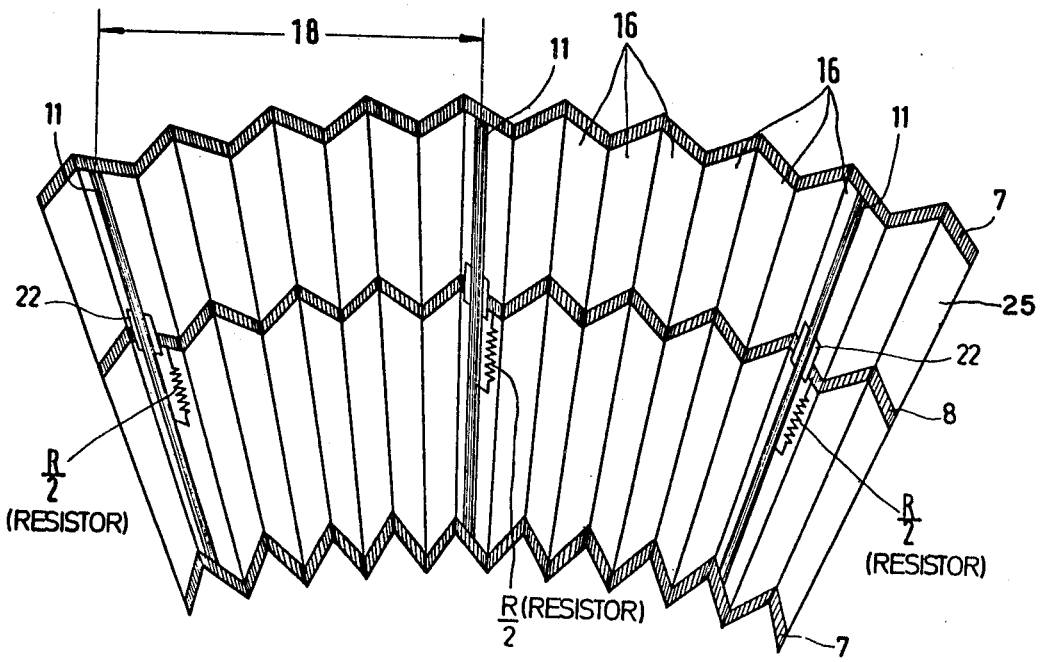

In order to facilitate the installation of the cable according to the invention through curves and corners, the cable may comprise insulating foils forming a carrier 25 for the conductors 7, 8 and be provided with cross wave shapes 16 as shown in FIGS. 9 and 10. Such wave shapes are known as such, for example, from German Patent Publication No. 2,142,280. According to the invention, it has been found to be practical to distribute the discrete circuit components such as the resistors R/2 in synchronism, so to speak, with the cross wave forms 16. Stated differently, the spacings 18 will be arranged in analogy to the spacings 17 in FIGS. 3–7 whereby the discrete circuit components are preferably located on a slope of the insulating carrier foils 25 forming the cable in the manner of a bellows. The fact that the spacings 18 may differ when the cable is installed in a curve as shown in FIG. 10 will not vary the electrical characteristics of the cable. The outer conductors 7 and the central conductor 8 are secured to said supporting insulating carrier foil 25 provided with the above mentioned folds or wave shapes 16. The conductors may be glued to the supporting insulating carrier foil 25 conventional manner. The short circuiting conductors 11 will be located due to the above mentioned "synchronization" on a slope rather than along a bend. Pieces of insulation 22 will be located between the central conductor 8 and the short circuiting conductors 11.

Figure 3:
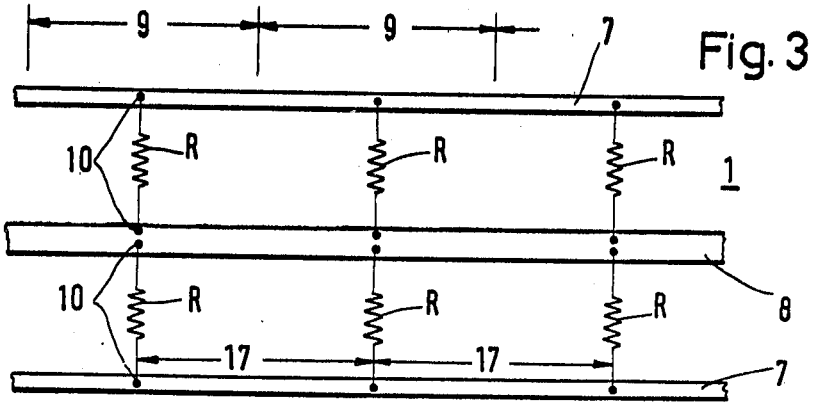
FIG. 3 illustrates an embodiment of a cable according to the invention in which a central conductor is arranged intermediate two outer conductors and having discrete resistors interconnected between the central conductor and the outer conductors.
Figure 4:
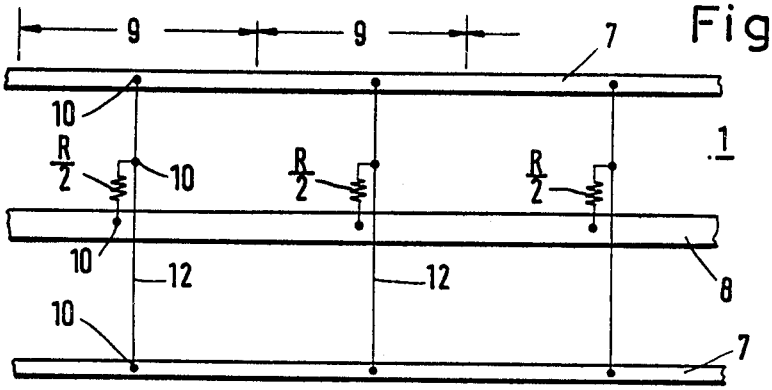
FIG. 4 is an embodiment similar to that of FIG. 3, however, short circuit conductors directly interconnect the outer conductors with each other at spaced intervals and discrete resistors connect the short circuit conductors with the central conductor.
Figure 5:
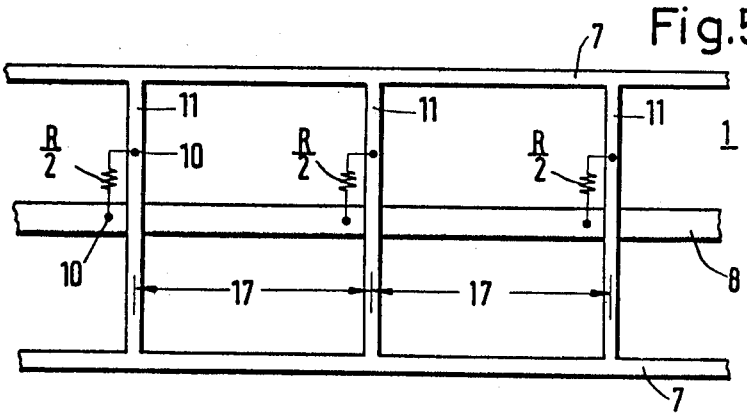
FIG. 5 is an embodiment similar to that of FIG. 4, however, the outer conductors and the short circuit conductors form an integral structure, for example, produced by stamping conductor foils.
Figure 11:
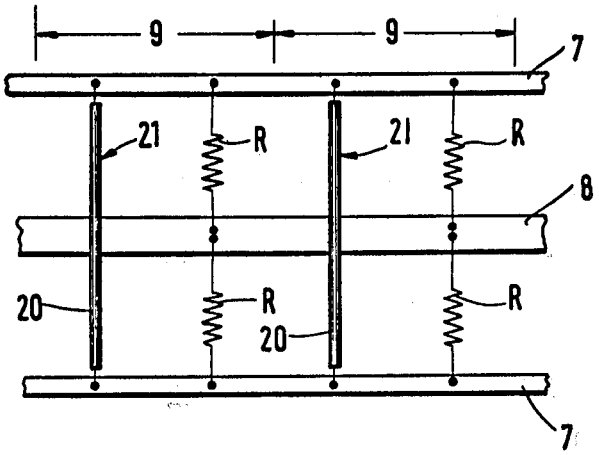
FIG. 11 illustrates an embodiment similar to FIG. 3, however, further including insulated short circuiting cross conductors.

According to FIG. 11 each outer conductor 7 is connected to the central conductor 8 by a plurality of separate discrete resistors R as shown in FIG. 3. However, in addition the outer conductors 7 are also short circuited by short circuit conductors 21 covered with insulation 20 except at the bared ends electrically connected to the outer conductor 7. The contacts between all the resistors R and the central conductor 8 may, for example, be accomplished by a welding step in a single operation, for example, by means of a welding electrode having a knife edge and extending along the central electrode 8. Similarly, it is possible to make the contacts between the resistors and the outer conductors as well as between the short circuit conductors and the outer conductors in respective welding operations. The short circuit conductors 21 are also spaced so that each section 9 comprises one short circuit conductor 21 and two resistors R as shown in FIG. 11. The short circuit conductors 21 may, for instance, be insulated copper wires from the ends of which the insulation has been removed so that no separate insulation is required between the short circuit conductor 21 and the central conductor 8. These short circuiting connections may be produced by supplying to the cable manufacturing apparatus the standard insulated wires 21 of uniform length and with the bare ends contacting the outer conductors 7. These short circuit conductors are uniformly spaced in such a manner that each cable section 9 receives one short circuiting conductor and the resistors R as shown in FIG. 11. A spacing between the conductors 21 and the resistors may, for example, correspond to one half of the length of a cable section 9. The contacts may be established by point welding, for example, whereby a respectively shaped electrode may be used.

Capacitors may be connected in parallel to the resistors. A cable according to the embodiment of FIG. 11 may also be easily corrugated as shown in FIGS. 9 and 10 because the short circuit conductors 21 and the resistors are sufficiently spaced. Moreover, the contacts between the outer conductors and the short circuit conductors on the one hand, and between the conductors and resistors on the other hand are also sufficiently spaced. Due to the insulation 20 no separate insulation is required between the central conductor 8 and the short circuit conductors 21. All elements extend across the cable and thus do not interfere with the corrugation.

Figure 12:
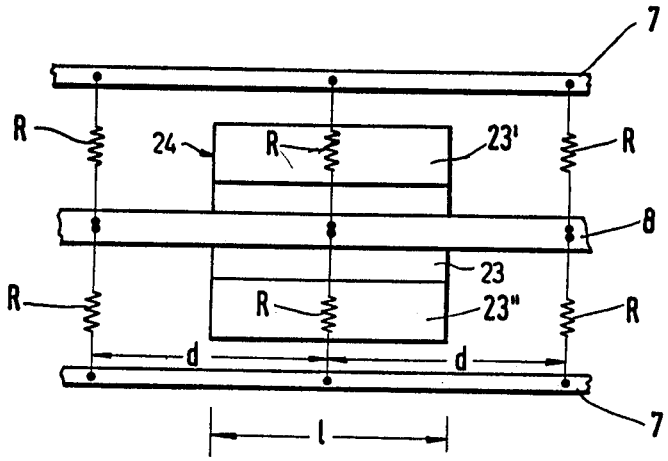
FIG. 12 illustrates an embodiment similar to that of FIG. 3 further showing a coupling member having a given length and carried by the vehicle shown in FIG. 1.

The above described advantage of the invention which resides in the possibility of controlling the phase shift by means of discrete capacities should be emphasized here since it provides the possibility of increasing the current amplitude resulting from the two high frequency signals induced in the cable by the transmitter coupler 3 and the compensating coupler 4. The resulting high frequency signal travels only in one direction along the cable 1 and due to the mentioned phase shift, it is possible to increase the efficiency or the effective range of the directional coupler. No change in the current amplitude and in the phase of the high frequency signal takes place between adjacent contacts along the length of cable extending between adjacent discrete circuit elements. The change in current amplitude and phase takes place only at the contacts that is where the discrete elements are electrically connected to the conductors of the cable. At these points the change in abrupt. Such abrupt change at the point of contact may result in errors as compared to prior art cables having a homogeneous attenuation along the entire length as described in the above prior art. The maximum of this error may amount to one half of the desired amplitude variation between two adjacent points of contact. Similarly, the maximum of this error with regard to the current phase may correspond to one half of the desired phase shift between two adjacent contact points. Where the high frequency signal transmitter moves along the cable, the error occurs periodically at the repetition frequency f and depends on a constant speed v of the traveling vehicle, thus $f=v/d$ whereby d is the spacing between two adjacent contact points as illustrated in FIG. 12. This spacing corresponds to the length of a cable section.

On the one hand, the mentioned error may reduce the directivity of the directional coupler. On the other hand, the error may influence the measuring of the distance between two adjacent vehicles in a column and thus endanger the column stability. Column stability in this context means that the desired spacings between adjacent vehicles in a column are rigidly maintained. These troublesome effects may be avoided sufficiently, for example, by providing very small spacings, for example, of a few mm between adjacent contact points of the discrete circuit elements and the conductors of the cable. However, such narrow spacings are not desirable because they increase the required material and manufacturing expenses of the cable. However, according to the invention the just outlined defects and thus the mentioned expenses may be avoided in a simple manner as shown in FIG. 12. The resistors R are equally spaced by spacings "d" along the length of the cable. According to one embodiment of the invention, these spacings "d" correspond to the length "1" of a coupler 23 carried on a vehicle 2 as shown in FIG. 1. The coupler 23 is merely illustrated in a symbolized form and may be a U-shaped core of a coil having core legs 23' and 23''. German Patent Publication No. 2,307,455 describes such coupling elements 23. The coupling element 23 is part of the equipment on the vehicles 2 used for controlling the traveling and braking operation in response to distance measurements relative to a vehicle or the like ahead. Further details regarding such equipment are disclosed in the above mentioned U.S. Pat. No. 3,836,770 and in German Patent Publication No. 2,114,621. Where a plurality of vehicles travel along the track and thus along the cable, a respective plurality of coupling elements 23 would be provided and according to the invention, the several coupling elements 23 may have different lengths "1." The various lengths of the coupling elements 23 will correspond to a whole number multiple of the length "1" the latter corresponds as mentioned, to the spacing "d." Thus, the various lengths of the coupling elements 23 may correspond to twice the length "1" or to thrice the length "1" and so forth.

It has been found that in a high frequency flat cable as just described, the current amplitude and phase of a high frequency signal coupled into such a cable or decoupled from such a cable, within the boundary 24 of the coupling element 23 is practically linear. Stated differently, the error may be eliminated by dimensioning the spacing "d" with due regard to the length "1" of the coupling element 23.

It has been ascertained that by making the spacing "d" 10 cm and by making the length "1" of the coupling elements 23 also 10 cm, the deviations remain below a value, relative to an ideal cable having a constant or homogeneous attenuation along its length, which value can be achieved by spacing the discrete elements 1 mm from each other without regard to the length "1" of the coupling elements.

It has also been found, that the curve of the current amplitude and phase coupled into the high frequency cable or decoupled from the high frequency cable also remains linear if the spacing "d" corresponds, for example, to one half, one third, or one quarter of the length "1" of the coupling element 23. Stated differently, the error eliminating effect is also achieved when the spacing "d" corresponds to a whole number fraction of the selected length "1" of the coupling elements 23.

In the embodiment of FIG. 12, the spacings "d" are adapted to the length "1" of the coupling elements 23. Thus, it is possible to practically construct a distance measuring device having the same electrical characteristics as in the instance where a high frequency flat cable is used having a homogeneous, constant attenuation along its length. The use of three conductors in the cable does not involve any drawbacks in this context.

Figure 13:
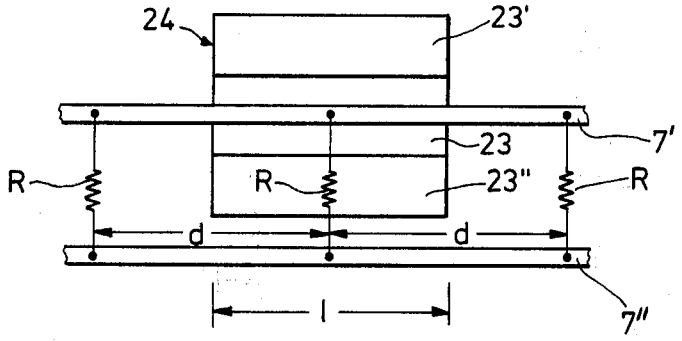
FIG. 13 shows an embodiment with two conductors and discrete resistors spaced along the length of the cable in accordance with the invention.

FIG. 13 illustrates an example embodiment of the invention similar to that of FIG. 12, however, without a central conductor. In FIG. 13 the conductors 7' and 7'' are spaced from each other by insulating means not shown. The coupling element 23 again has a given length "1" and the discrete circuit elements such as resistors R and/or capacitors are spaced from each other by spacings "d" relating to the length "1" of the coupling member 23 in such a manner that the distance "d" corresponds to a whole number fraction of the given length "1," said whole number fraction may "1."

Compared to the high frequency cable having three conductors including a central conductor, the embodiment with two conductors has the advantage that less material is necessary and that the width of the cable can be smaller thereby providing an improved rigidity against bending loads. Thus, it is possible to install the cable, especially the cable of the embodiment of FIG. 13, in a vertical position along the railroad track. Further, the embodiment with two conductors is not necessarily required to have corrugations or folds across its length as described above with reference to FIGS. 9 and 10.

Although the invention has been described with reference to specific example embodiments, it will be appreciated, that it is intended to cover all modifications and equivalents within the scope of the appended claims.

What is claimed is:

1. A flat high frequency cable for cooperation with coupling members having a given length and forming part of transmitter and receiver means, said cable comprising longitudinal conductor means having a given conductivity and including at least two longitudinal conductors, insulating means locating said conductor means in spaced relationship relative to each other along their entire length, discrete transverse conductor means having a transverse conductivity substantially smaller than said given longitudinal conductivity, said discrete transverse conductor means comprising a number of discrete components, and means connecting said discrete components to said longitudinal conductors along the length thereof to provide a defined attenuation along the cable, said discrete components and their connections to said longitudinal conductor means being spaced from each other by a distance corresponding to a whole number fraction of said given length of said coupling members.

2. The cable of claim 1, wherein said discrete components are ohmic resistors.

3. The cable of claim 1, wherein said discrete components are capacitors.

4. The cable of claim 1, wherein said whole number fraction corresponds to 1.

5. The cable of claim 1, wherein said given length corresponds to that of the shortest coupling member of a plurality of coupling members, the lengths of which are related to each other by a rational relationship.

6. The cable of claim 1, wherein said discrete components have equal spacings from each other.

7. The cable according to claim 1, wherein said connecting means comprise crimped contacts between said longitudinal conductors and said discrete components.

8. The cable according to claim 1, wherein said connecting means comprise electrically conductive adhesive contacts between said longitudinal conductors and said discrete components.

9. The cable according to claim 1, wherein said connecting means comprise welded contacts between said longitudinal conductors and said discrete components.

10. The cable of claim 1, wherein said connecting means comprise soldered contacts between said longitudinal conductors and said discrete components.

11. The cable of claim 1, wherein said connecting means comprise ultrasonically bonded contacts between said longitudinal conductors and said discrete components.

12. The cable of claim 1, further comprising carrier strip means for said discrete components, said discrete components being secured to said carrier strip means.

13. The cable of claim 1, wherein said discrete components have equal spacings from each other, said cable further comprising a wave or corrugated shape, said spacing being synchronized with said wave shape.

14. The cable of claim 13, wherein said wave or corrugated shape comprises wall members, said discrete components being arranged along certain ones of said wall members between adjacent bends in the cable.

15. The cable of claim 1, wherein said conductor means comprise two outer longitudinal conductors and a central longitudinal conductor, and wherein said discrete compounds comprise two discrete component elements at each location, one element being connected between the central conductor and one outer conductor, the other element being connected between the central conductor and the other outer conductor at each location.

16. The cable according to claim 1, wherein said discrete components are mechanically machined for balancing.

* * * * *

UNITED STATES PATENT OFFICE

CERTIFICATE OF CORRECTION

Patent No. 4,166,259 Dated August 28, 1979

Inventor(s) Walter Hermann et al

It is certified that error appears in the above-identified patent and that said Letters Patent are hereby corrected as shown below:

Claim 13, line 4, "spacing" should be --spacings--.

Claim 15, line 4, "compounds" should be --components--.

---

Signed and Sealed this

*Twentieth* Day of *November 1979*

[SEAL]

*Attest:*

RUTH C. MASON
*Attesting Officer*

LUTRELLE F. PARKER
*Acting Commissioner of Patents and Trademarks*